United States Patent [19]

Shiga

[11] Patent Number: 4,489,317

[45] Date of Patent: Dec. 18, 1984

[54] CATHODE RAY TUBE APPARATUS

[75] Inventor: Seiji Shiga, Kanagawa, Japan

[73] Assignee: International Business Machines Corporation, Armonk, N.Y.

[21] Appl. No.: 574,189

[22] Filed: Jan. 25, 1984

Related U.S. Application Data

[63] Continuation of Ser. No. 216,887, Dec. 16, 1980, abandoned.

[30] Foreign Application Priority Data

Dec. 20, 1979 [JP] Japan ..... 54-164846

[51] Int. Cl.[3] ..... G09G 1/16

[52] U.S. Cl. ..... 340/726; 340/723; 340/750

[58] Field of Search ..... 340/726, 723, 724, 750, 340/748, 744, 798, 799

[56] References Cited

U.S. PATENT DOCUMENTS

| | | | |
|---|---|---|---|
| 3,242,470 | 3/1966 | Hagelbarger | 340/724 |
| 3,643,252 | 2/1972 | Roberts, Jr. | 340/726 |
| 3,680,077 | 7/1972 | Hoberecht | 340/726 |
| 3,792,462 | 2/1974 | Casey | 340/726 |
| 4,203,107 | 5/1980 | Lovercheck | 340/709 |

OTHER PUBLICATIONS

IBM Technical Disclosure Bulletin, vol. 19, No. 3, (Aug. 1976), pp. 1081-1084, "Formattable Video Band Display", by D. J. Chesarek.

*Primary Examiner*—Marshall M. Curtis
*Attorney, Agent, or Firm*—Frederick D. Poag

[57] ABSTRACT

A cathode ray tube display apparatus is provided comprising a regenerating buffer memory, a row address table and a pointer. The regenerating buffer memory has a greater storage capacity than the display capacity of the CRT screen and stores character information. The row address table has a capacity storing more addresses indicating the rows in the regenerating buffer memory than the number of rows on the CRT screen. The pointer designates an address of the table for determining the stored position of the regenerating memory to be first accessed by the table. This cathode ray tube display apparatus is capable of scrolling and paging easily and quickly without changing the content of the regenerating buffer memory and the row address table.

15 Claims, 17 Drawing Figures

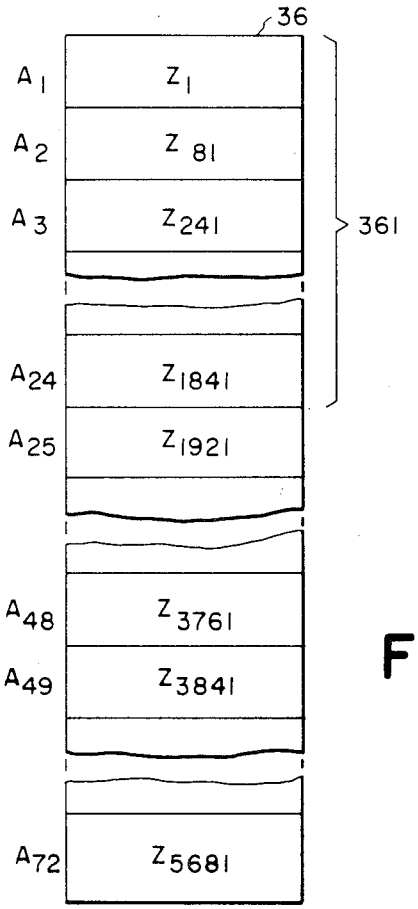
FIG. 16
FIG. 17
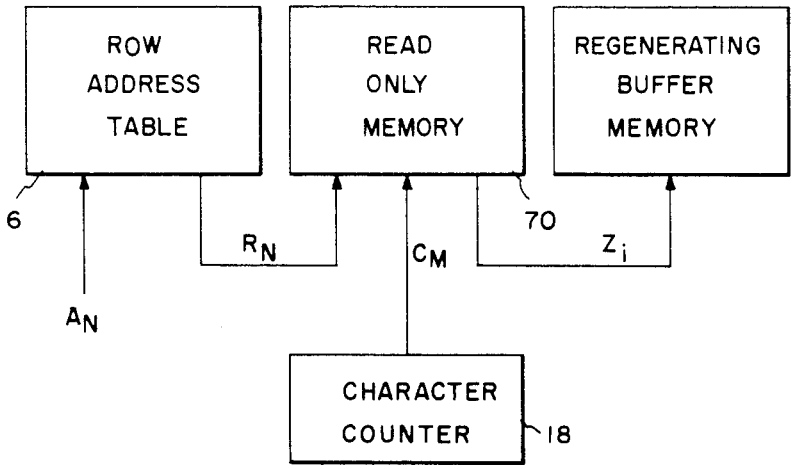

CATHODE RAY TUBE APPARATUS

This application is a continuation of application Ser. No. 06/216,887, filed 12/16/80 now abandoned.

FIELD OF THE INVENTION

This invention relates generally to a cathode ray tube display apparatus, and more particulary to a cathode ray tube display apparatus suitable for scrolling and paging.

BACKGROUND OF THE INVENTION

Heretofore, a method for switchably displaying a plural number of messages on a cathode ray tube display apparatus by storing a plural number of messages in the regenerating buffer memory and providing an address signal designating a message from the computer or the external controller has been proposed (see, for example, Unexamined Published Japanese patent application No. 49-22823). In accordance with such a method, however, the memory must be rewritten whenever a part of the message displayed will be changed, and no scrolling can be made because the address signal designates a full message in a frame.

Another method for scrolling without rewriting the content of the regenerating buffer memory is to provide a row address table for storing the address information of the regenerating buffer memory in the displaying order, and to change the arrangement of the row address stored in the row address table (see, for example, Unexamined Published Japanese patent application No. 50-116238). In such a method, however, the content of the row address table must be rewritten each time of scrolling, so the efficiency is lowered.

Another method for not only switchably displaying messages on a cathode ray tube display apparatus but also achieving scrolling by providing a regenerating buffer memory of a capacity greater than the number of characters displayed on the CRT, storing the start address corresponding to a message displayed on the CRT among the contents of the regenerating buffer memory in a register, and reading out characters in a message starting at the start address from the regenerating buffer memory has also been proposed (see, for example, Unexamined Published Japanese patent Application No. 51-51243). Although this method can be used for switchably displaying a plural number of messages by changing the start address, and also for scrolling, characters to be displayed must be sequentially stored in the regenerating memory, so allocating of the memory is not made freely, and when there is a requirement to change a part of the content of a frame, the memory must be rewritten.

SUMMARY OF THE INVENTION

The present invention, therefore, contemplates the elimination of such disadvantages in the prior art. The first object of the present invention is to provide a cathode ray tube display apparatus of a simple structure which is capable of scrolling and paging easily and quickly without changing the contents of the regenerating buffer memory and the row address table.

The second object of the present invention is to provide a cathode ray tube (hereinafter referred as CRT) display apparatus which is capable of partitioning, inserting and deleting easily and quickly without rewriting the regenerating buffer memory.

The third object of the present invention is to provide a CRT display apparatus which can store desired character information in an optional location of the regenerating buffer memory.

The fourth object of the present invention is to provide a general purpose CRT display apparatus which can readily adapt itself to changes of display conditions such as the number of characters and rows displayed on the screen.

In accordance with the present invention, these objects are achieved by providing a CRT display apparatus comprising a regenerating buffer memory having a greater storage capacity than the display capacity of the CRT screen and storing character information; a row address table having a capacity for storing more addresses indicating the rows in said memory than the number of rows on the CRT screen and storing addresses indicating said rows in the desired order; and a pointer designating an address of said table (e.g., an address of said table storing the address indicating the row of the reproducing buffer memory in which the character information to be first displayed is stored) for determining the stored position of said memory to be accessed by the table, wherein addresses indicating the rows, stored in the predetermined number of addresses of the row address table, are sequentially read out in response to the table address stored in said pointer, and character information stored in the regenerating buffer memory at the addresses indicating the rows are read out and displayed.

Scrolling can be made by changing the table address stored in the pointer to a table address above or below the former table address.

Paging can be made by changing the table address stored in the pointer to a table address one or more frames above or below the former table address.

The detail of the preferred embodiment of the CRT display apparatus of the present invention will be described in connection with the accompanying drawings.

BRIEF DESCRIPTION OF THE DRAWINGS

FIG. 16 is a diagrammatic representation of an example of the contents stored in the row address table of the embodiment shown in FIG. 15.

FIG. 17 is a schematic block diagram showing another addressing system of the regenerating buffer memory of the embodiment shown in FIG. 15.

DETAILED DESCRIPTION

Figure 1:
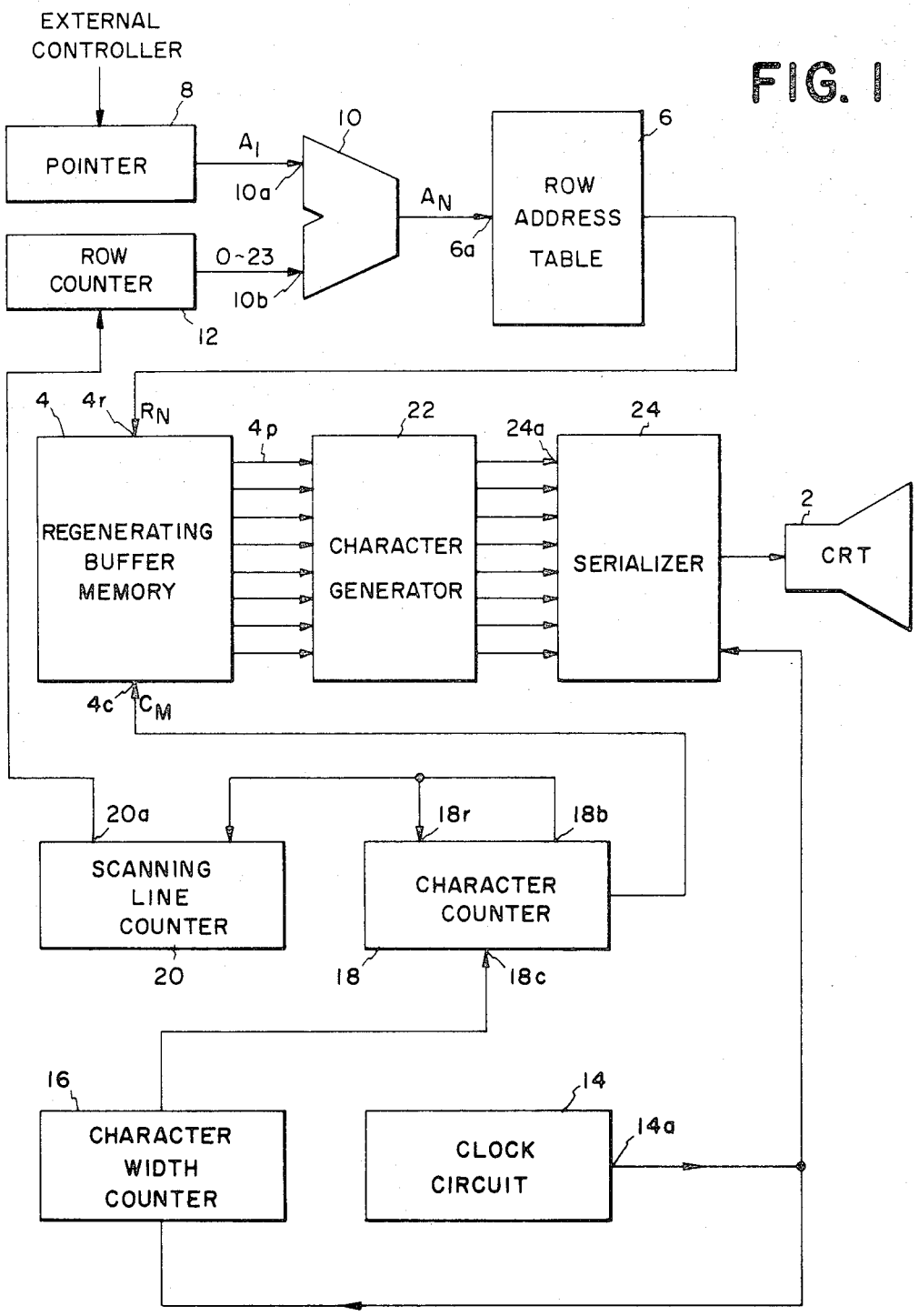
FIG. 1 is a schematic block diagram showing a preferred embodiment of the CRT display apparatus of the present invention.
Figure 2:
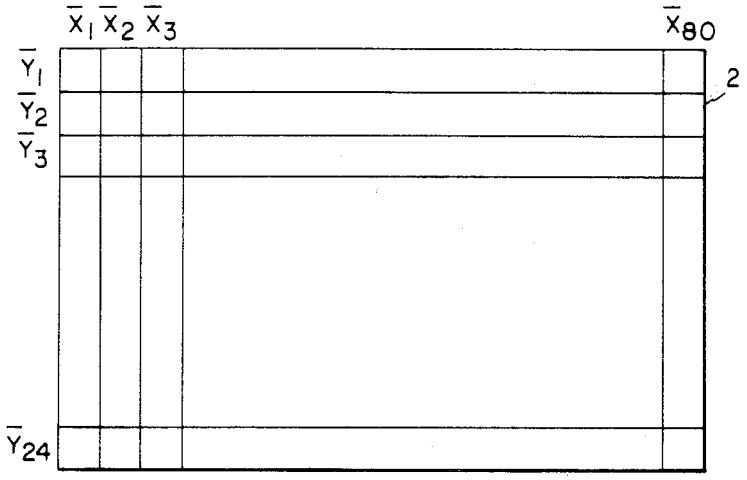
FIG. 2 is a diagrammatic representation of the CRT screen shown in FIG. 1.
Figure 3:
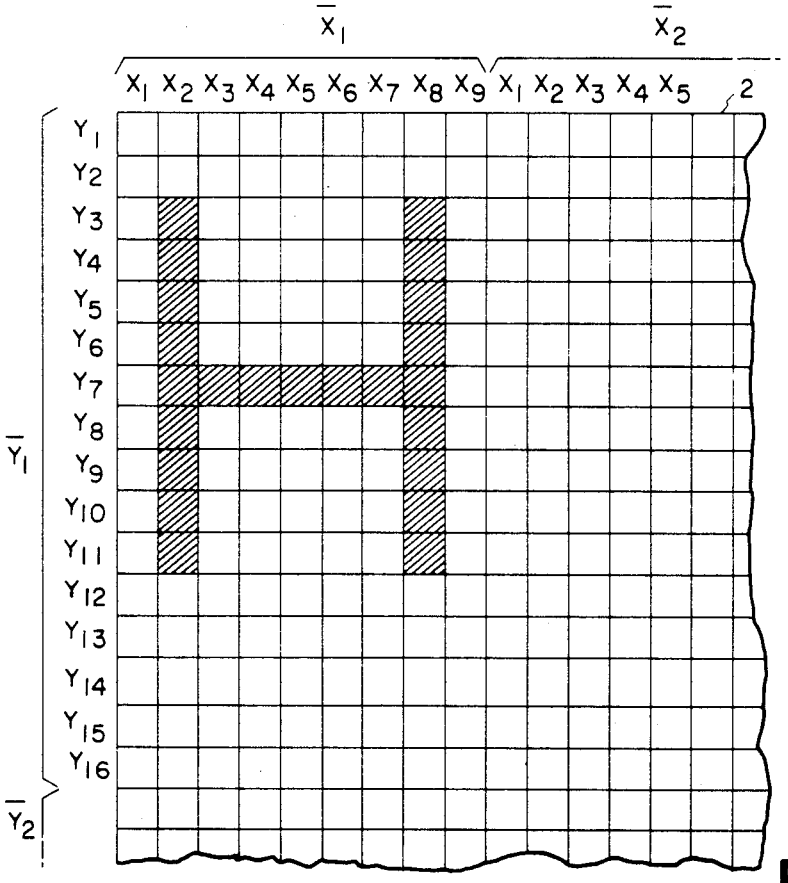
FIG. 3 is a diagrammatic representation of the dot matrix of the CRT shown in FIG. 1.
Figure 4:
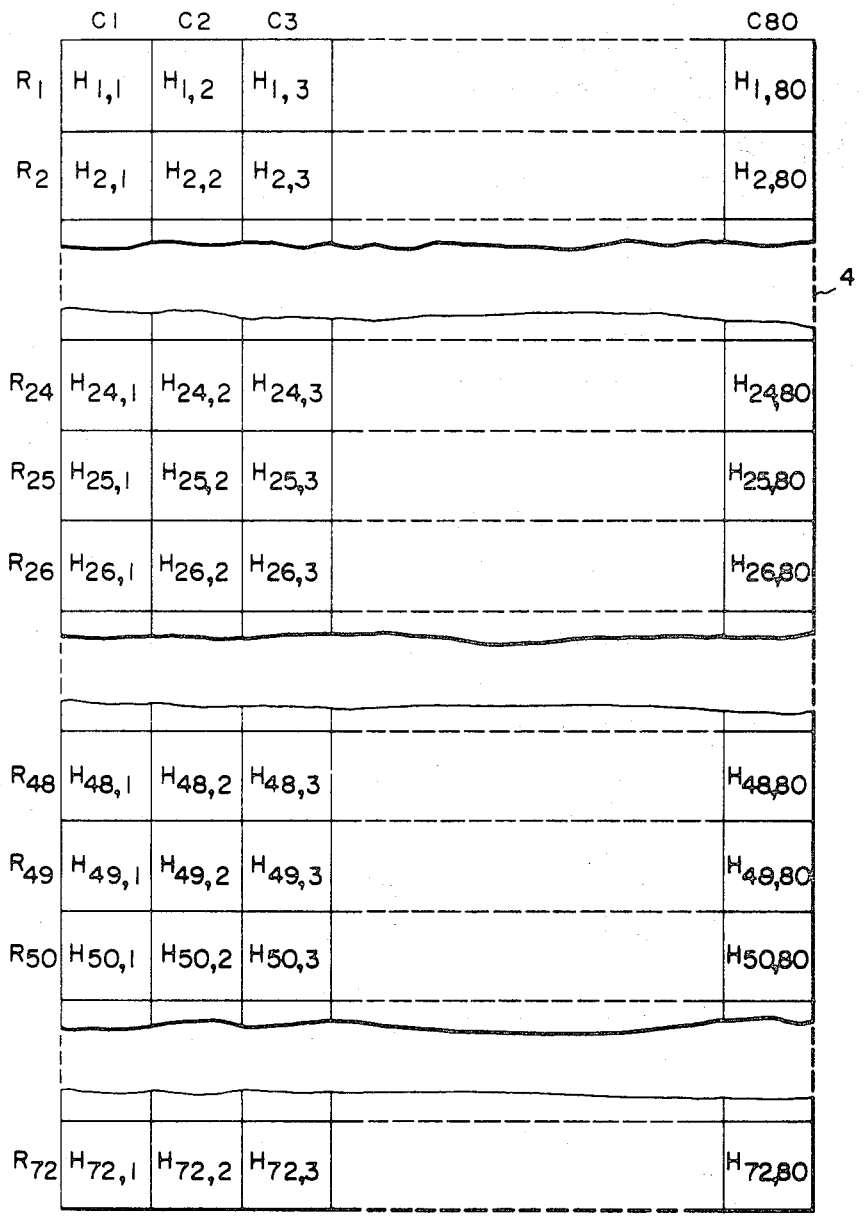
FIG. 4 is a diagrammatic representation of the organization of the regenerating buffer memory shown in FIG. 1.

Referring to FIG. 1, a preferred embodiment of the CRT display apparatus in accordance with the present invention is shown. The CRT 2 has, for example, a display capacity of 80 characters by 24 rows as shown in FIG. 2, and displays a character on each of display positions shown by X-coordinates $\overline{X}_1$ to $\overline{X}_{80}$, and Y-coordinates $\overline{Y}_1$ to $\overline{Y}_{24}$. Each character is composed of a dot matrix of 7 dots wide and 14 dots high as shown in FIG. 3, and the area of the raster assigned to each character is 9 dots wide and 16 dots high. In FIG. 3 the character "H" is displayed. The regenerating buffer memory 4 is in the form of a random access memory having a greater storage capacity than the display capacity of the screen of the CRT 2. For purpose of discussion, the memory 4 is assumed to have a storage capacity of 72 rows of characters, or a storage capacity three times the display capacity of the CRT screen. FIG. 4 shows an example of the regenerating buffer memory. In the memory illustrated in this figure, the storage location is designated by the row address $R_N$ (N=1, 2, —, 72) and the character position information $C_M$ (M=1, 2, —, 80), and a coded character is read out from or written into the storage location. ($R_N$ and $C_M$ are integers which increase one by one.) In the storage location designated by the row address $R_N$ and the character location information $C_M$, a coded character $H_{N,M}$(N=1,2,—,72, M=1,2,—,80) is stored.

Figure 5:
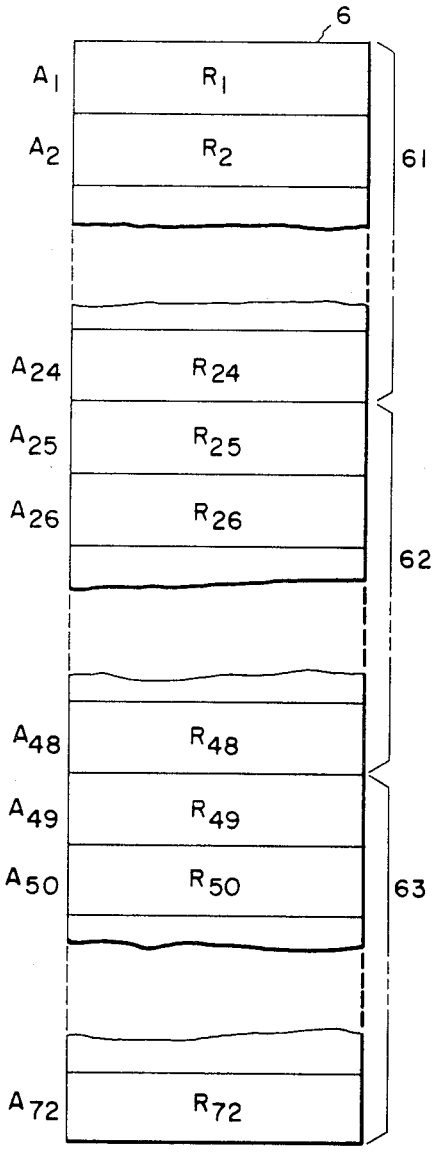
FIG. 5 is a diagrammatic representation of the organization of the row address table shown in FIG. 1.

The row address table 6 selects the row address $R_N$ of character information to be displayed from among the character information stored previously in the regenerating buffer memory, so as to combine and arrange that information for display. The row address table 6 has a larger number of storage locations than the number of rows of the CRT screen, and in this embodiment, it can store row addresses corresponding to three frames as shown in FIG. 5. It is assumed that the storage parts corresponding to addresses $A_1$ to $A_{24}$, $A_{25}$ to $A_{48}$, and $A_{49}$ to $A_{72}$ are called the first, second, and third page storage parts, respectively. In order to simplify the description, it is assumed that the row addresses $R_N$ (N=1,2,—,72) is stored in the addresses, $A_N$(N=1,2,—, 72) of the row address table 6. The addresses $A_N$ are integers which increase one by one.

The pointer 8 stores and designates the addresses $A_N$ of the row address table 6 to be first addressed in accordance with the instruction from a program or an external controller (not shown). The output terminal of the pointer 8 is connected to one of input terminals 10*a* of the adder 10. The output terminal of a row counter 12 is connected to the other input terminal 10*b* of the adder 10, and the output terminal of the adder 10 is connected to the address input terminal 6*a* of the row address table 6. The row counter 12 of this embodiment repeatedly outputs numbers, 0, 1, 2, —, 23 in order. For instance, when the pointer 8 outputs the row address $A_1$, the row counter 12 first outputs the number "0", and both outputs are added by the adder 10. When the output $A_1$ of the adder 10 accesses the address $A_1$ of the row address table 6, the row address $R_1$ is outputted from the table 6. The row counter 12 then outputs the number "1", the adder 10 adds the output $A_1$ of the pointer 8 to the output "1" of the row counter 12 and outputs the address $A_2$ and the row address $R_2$ is read out from the address $A_2$ of the row address table 6. The same actions are repeated, and when the number "23" is outputted from the row counter 12, the adder 10 adds the output $A_1$ of the pointer 8 to the number "23" and outputs the address $A_{24}$, and the row address $R_{24}$ is read out from the row address table 6. Thus, row addresses $R_1$ to $R_{24}$ of the regenerating buffer memory 4 stored in the first page storage part 61 of the table 6 are read out, and character information corresponding to these row addresses $R_1$ to $R_{24}$ is displayed in a form as described below. When character information corresponding to row addresses stored in the second page storage part 62 is to be displayed, the pointer 8 designates the address $A_{25}$, and when character information corresponding to row addresses stored in the third page storage part 63 is to be displayed, the pointer 8 designates the address $A_{49}$.

The operation timing and the step-by-step operation of the row counter 12 are controlled by a clock circuit 14, a character width counter 16, a character counter 18, and a scanning line counter 20. The clock circuit 14 determines the dot spacing of the dot matrix, and outputs a pulse for each of dot coordinates, $X_1$, $X_2$, —, $X_9$ shown in FIG. 3. The output terminal 14*a* of the clock circuit 14 is connected to the clock input terminal 24*c* of a serializer 24, and is also connected to the input terminal of the character width counter 16. The character width counter 16 is a nonary (i.e., nine) counter which corresponds to the raster width assigned to a character. Each time a horizontal line scanning for each character has been completed, the character width counter 16 outputs a pulse, and its cycle equals the time required for sweeping a character width.

The output terminal of the character width counter 16 is connected to the clock input terminal 18*c* of the character counter 18. The character counter 18 is a counter which is stepped by a pulse from the character width counter 16 to a count of 80, and outputs the character position information $C_1$, $C_2$, —, $C_{80}$ of the regenerating buffer memory 4 to the address input terminal 4*c* of the memory 4 sequentially. The character counter 18 generates a pulse on the output terminal 18*b* when it outputs the character location count $C_{80}$, i.e., a scanning time equivalent to 80 character widths is passed. This pulse is input to the reset input terminal 18*r* of the character counter 18, and said counter 18 is reset. The output terminal 18*b* of the character counter 18 is also connected to the input terminal of the scanning line counter 20. The scanning line counter 20 is a hexadecimal counter, which corresponds to the height of the dot matrix to display a character. That is, pulses sequentially put out from the output terminal 18*b* of the character counter 18 correspond to the Y-coordinates $Y_1$, $Y_2$, —, $Y_{16}$ of the dot matrix shown in FIG. 3, and the scanning line counter 20 is stepped by such pulses and when the count becomes 16, or 16 scanning lines equivalent to completely scanning of character in a row are generated, it outputs a pulse to the row counter 12. The row counter 12 is stepped by the pulse from the scanning line counter 20.

Referring again to the row address table 6, the output terminal of the row address table 6 is connected to the row address input terminal 4*r* of the regenerating buffer memory 4. The storage location of the regenerating buffer memory 4 is designated by the row address $R_N$ output from the row address table 6 and the character location count $C_M$ output from the character counter 18. That is, the row address table 6 has a function to designate the row storing selected character information, and the character counter 18 has a function to select a particular character in the row designated by the table 6. For instance, when the table 6 outputs the row address $R_{24}$ and the counter 18 outputs the character location count $C_3$, the coded character "$H_{24,3}$" is outputted regenerating buffer memory 4.

The parallel output lines 4*p* of the regenerating buffer memory 4 are connected to the input terminals of the character generator 22. The character generator 22 decodes the coded characters fed from the regenerating buffer memory 4 and converts them to video data. The output terminals of the character generator 22 are connected to the input terminals 24*a* of the serializer 24. The serializer 24 has a function to convert the parallel inputs from the character generator 22 to a serial output for controlling the beam intensity of the CRT 2, and this serial output is synchronized with the pulse from the clock circuit 14 and is input to the CRT 2.

The operation of the embodiment thus structured is hereinafter described. First described is the displaying of character information corresponding to the row address stored in the first page memory 61 of the row address table 6. In this case, the address $A_1$ is inputted to the pointer 8 which is in turn added to the output "0" of the row counter 12 by means of the adder 10, then the address $A_1$ of the row address table 6 is accessed. Then, the row address $R_1$ is generated from the table 6, and the address $R_1$ of the regenerating buffer memory 4 is accessed. On the other hand, the character location count $C_1$ is first fed from the character counter 18 to the regenerating buffer memory 4. Thus, the character "$H_{1,1}$" stored in the location designated by the row address $R_1$ and the character location count $C_1$ is read out from the regenerating buffer memory 4, and is inputted to the character generator 22. The character generator 22 generates dots corresponding to the first scanning line of the character "$H_{1,1}$" (the scanning line corresponding to the coordinate $\overline{Y}_1$ of the dot matrix of the row $Y_1$ on the screen). These dots are serialized by means of the serializer 24, and inputted to the b intensity controller of the CRT 2. When the first scan of "$H_{1,1}$" has been completed, the output of the character width counter 16 increases the output of the character counter 18 by one, and the character location count $C_2$ is put out. Thus, the second character "$H_{1,2}$" corresponding to the row address $R_1$ is read out from the regenerating buffer memory 4, and inputted to the character generator 22. The character generator 22 generates dots corresponding to the first scanning line of the second character "$H_{1,2}$", and these dots are serialized by means of the serializer 24 and input to the beam intensity controller of the CRT 2. The same operations are repeated on the character location counts $C_3$ to $C_{80}$ (hence, the characters "$H_{1,3}$" to "$H_{1,80}$"); thus scanning corresponding to the coordinate $Y_1$ of the dot matrix of the row $\overline{Y}$HD 1 on the CRT screen is completed.

When the first horizontal scan has been completed, the character counter 18 is reset, and outputs the character location count $C_1$ again. Therefore, the first character "$H_{1,1}$" stored in the location designated by the row address $R_1$ and the character location count $C_1$ is read out from the regenerating buffer memory 4, and the character generator 22 generates dots corresponding to the second scanning line of the character "$H_{1,1}$" (the scanning line corresponding to the coordinate $Y_2$ of the row $\overline{Y}_1$ on the CRT screen). These dots are serialized by means of the serializer 24 and supplied to the beam intensity controller of the CRT 2. When the second scan of the first character "$H_{1,1}$" has been completed, the output of the character width counter 16 increases the output of the character counter 18 by one, and the character address $C_2$ is outputted. Then, the second character "$H_{1,2}$" on the row corresponding to the row address $R_1$ is read out from the regenerating buffer memory 4, and input to the character generator 22. The character generator 22 generates dots corresponding to the second line of the second character "$H_{1,2}$". These dots are serialized, by means of the serializer 24 and supplied to the beam intensity controller of the CRT 2. The same operations are repeated on the characters "$H_{1,3}$" to "$H_{1,80}$" designated by the character location counts $C_3$ to $C_{80}$. Thus, scanning corresponding to the coordinate $Y_2$ of the dot matrix of the row $\overline{Y}_1$ is completed. The same operations are also repeated on the scanning lines corresponding to the coordinates $Y_3$ to $Y_{16}$ of the dot matrix, and $$H_{1,1}, H_{1,2}, H_{1,3}, —, H_{1,80}$$

are displayed on the row $\overline{Y}_1$ on the CRT screen.

Figure 6:
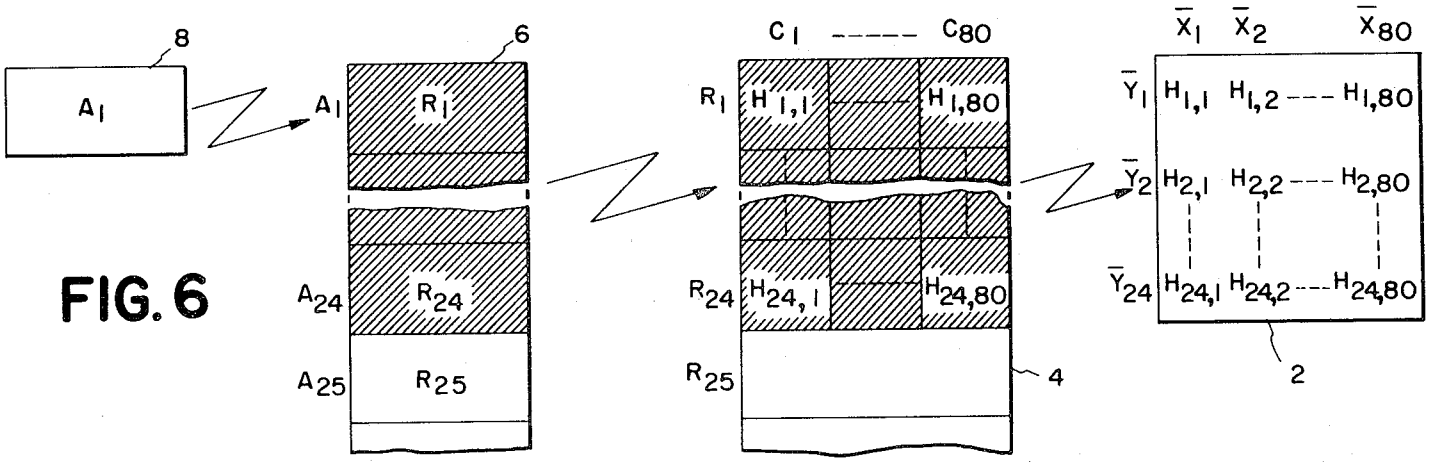
FIG. 6 is a diagrammatic representation of the display of character information in memory corresponding to row addresses stored in the first page of the row address table.

When scanning for the row $\overline{Y}_1$ on the CRT screen has been completed, the scanning line counter 20 inputs a pulse to the row counter 12 which in turn outputs "1". The output "1" of the row counter 12 is added to the output $A_1$ of the pointer 8 by means of the adder 10 which in turn outputs the address $A_2$. Then, the row address table 6 outputs the row address $R_2$ stored in the address $A_2$, and the row address $R_2$ of the regenerating buffer memory 4 is accessed. The character information stored in the row address $R_2$ is displayed on the row $\overline{Y}_2$ on the CRT screen in the same manner that the character information of the row address $R_1$ mentioned above is displayed on the row $\overline{Y}_1$ on the CRT screen. Thus, on the row $\overline{Y}_1$ and the row $\overline{Y}_2$, $$H_{1,1}, H_{1,2}, H_{1,3}, —, H_{1,80}, \text{and}$$

$$H_{2,1}, H_{2,2}, H_{2,3}, —, H_{2,80}$$

are displayed, respectively. Similarly, the character information stored in the addresses $A_3$ to $A_{24}$ of the row address table 6 corresponding to the row addresses $R_3$ to $R_{24}$ is displayed. FIG. 6 illustrates the displaying operation described above.

Next, the operation shifting all the characters displayed on the CRT screen upward by one row, known as the scrolling up operation, is hereinafter described. In this case, the address $A_2$ is inputted to the pointer 8. The output $A_2$ of the pointer 8 is added to the output "0" of the row counter 12 by means of the adder 10 which in turn outputs the address $A_2$. Thus, the address $A_2$ is accessed in the table 6 so that the row address $R_2$ stored in the table 6 is outputted. On the other hand, the character counter 18 outputs the count $C_1$, so that character "$H_{2,1}$" stored in the location designated by the row address $R_2$ and the character location count $C_1$ is read out from the regenerating buffer memory 4, and is inputted to the character generator 22. The character generator 22 generates dots corresponding to the first scanning line of the character "$H_{2,1}$" (the scanning line corresponding to the coordinate $Y_1$ of the dot matrix of the row $\overline{Y}_1$ on the screen). These dots are serialized by means of the serializer 24, and supplied to the beam intensity controller of the CRT 2. When the first scan of the character "$H_{2,1}$" is completed, the output of the character width counter 16 increases the output of the character counter 18 by one, to yield the character location count $C_2$. Then, the second character "$H_{2,2}$" of the row corresponding to the row address $R_2$ is read out from the regenerating buffer memory 4, and the first scanning on the character "$H_{2,2}$" is carried out. The same operations are repeated on characters "$H_{2,3}$" to "$H_{2,80}$" designated by the character location counts $C_3$ to $C_{80}$, and the scan corresponding to the coordinate $Y_1$ of the dot matrix of the row $\overline{Y}_1$ on the CRT screen is completed. Similarly, scanning on the coordinates $Y_2$ to $Y_{16}$ is also carried out, and $$H_{2,1}, H_{2,2}, H_{2,3}, —, H_{2,80}$$

are displayed on the row $\overline{Y}_1$ on the CRT screen.

When the scan of the row $\overline{Y}_1$ on the CRT screen has been completed, the scanning line counter 20 inputs a pulse to the row counter 12 so that the row counter outputs the number "1". The output "1" of the row counter 12 is added to the output $A_2$ of the pointer 8 by means of the adder 10 which in turn outputs the address $A_3$. Table 6 then outputs the row address $R_3$ stored in the address $A_3$ so that row address $R_3$ is accessed in the regenerating buffer memory 4. The character information stored in the row address $R_3$ is displayed on the row $\overline{Y}_2$ of the CRT screen in the same manner in that the character information of the row address $R_2$ mentioned above is displayed on the row $\overline{Y}_1$ of the CRT screen. Thus, the row $\overline{Y}_1$ and the row $\overline{Y}_2$ of the CRT screen display as follows:

$$H_{2,1}\ H_{2,2}\ H_{2,3} —H_{2\ 80}$$

$$H_{3,1}\ H_{3,2}\ H_{3,3} —H_{3,80}$$

Figure 7:
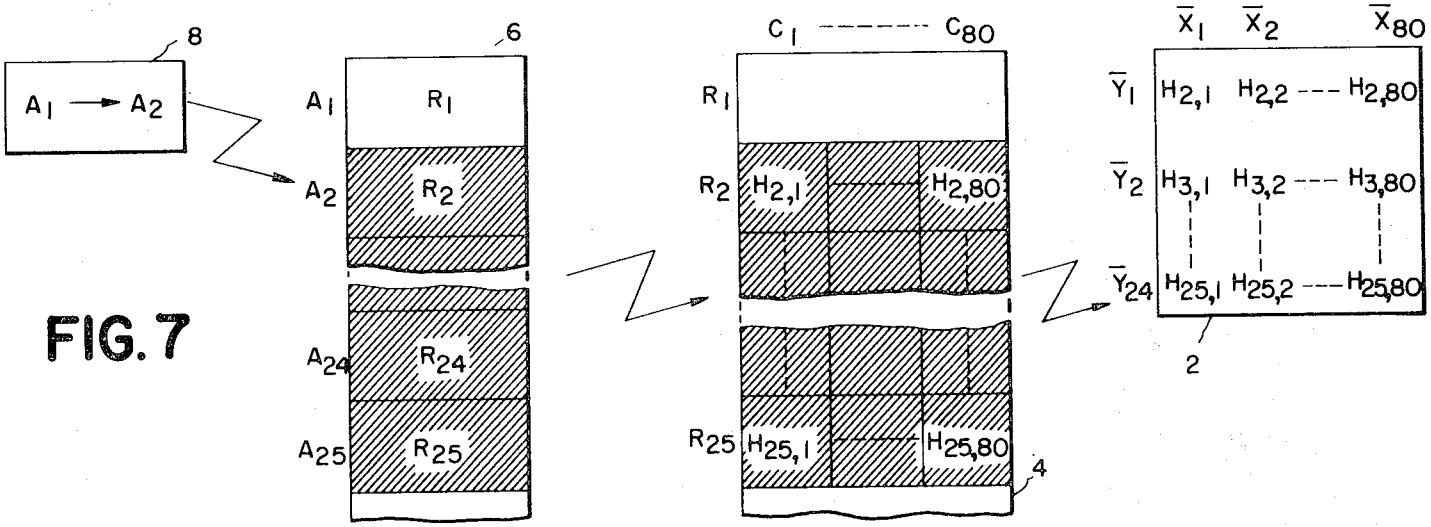
FIG. 7 is a diagrammatic representation of an example of scrolling of the CRT display apparatus shown in FIG. 1.

Similarly, the character information corresponding to row addresses $R_4$ to $R_{25}$ stored in addresses $A_4$ to $A_{25}$ of the table 6 is displayed. Therefore, the information on the CRT screen shown in FIG. 6 is shifted by one row upward. FIG. 7 illustrates such a scrolling up operation. The scrolling up operation described above is hereinafter summarized with reference to FIG. 7. When the address $A_2$ is set in the pointer 8 instead of the address $A_1$, addresses $A_2$ to $A_{25}$ of the row address table 6 are sequentially accessed so that row addresses $R_2$ to $R_{25}$ stored in these addresses are sequentially outputted. Then row address $R_2$ to $R_{25}$ of the regenerating buffer memory are sequentially accessed, and the CRT screen displays $H_{2,1}$ —$H_{2,80}$, $H_{3,1}$ —$H_{3,80}$, —, $H_{25,1}$ —$H_{25,80}$.

Figure 8:
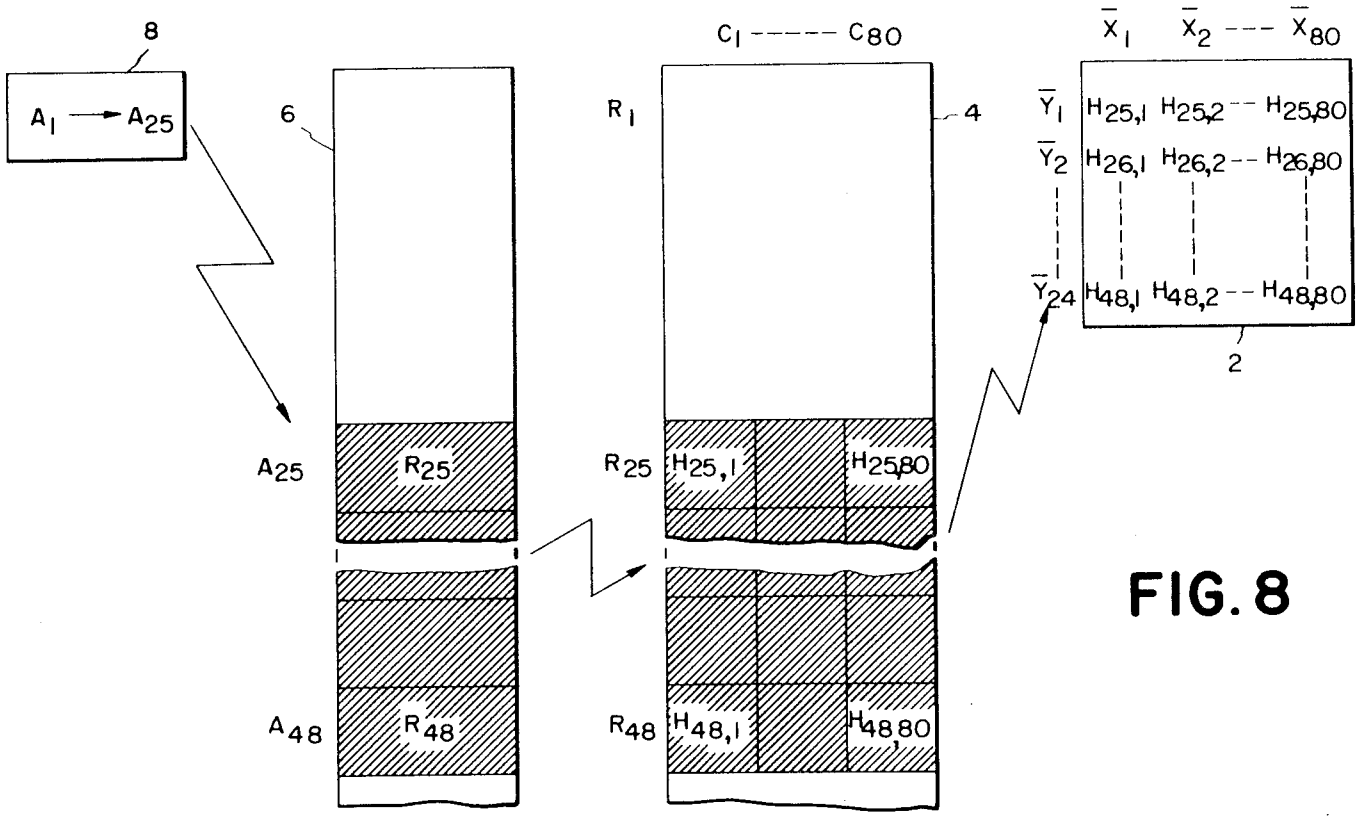
FIG. 8 is a diagrammatic representation of an example of paging of the CRT display apparatus of FIG. 1.

Next, the operation to change information on the CRT screen completely, known as "paging", is hereinafter described. FIG. 8 illustrates an example of paging. In this example, the character information corresponding to the row addresses stored in the second page memory 62 of the row address table 6, instead of the character information corresponding to the row addresses stored in the first page memory 61, will be displayed. In this case, the address $A_{25}$ is inputted to the pointer 8. Therefore, addresses $A_{25}$ to $A_{48}$ of the row address table 6 are sequentially addressed so that row addresses $R_{25}$ to $R_{48}$ stored in these addresses are sequentially output. Then, row addresses $R_{25}$ to $R_{48}$ of the regenerating buffer memory 4 are sequentially accessed, and the CRT displays

| | |
|---|---|
| $H_{25,1}\ H_{25,2}\ H_{25,3} \cdots$ | $H_{25,80}$ |
| $H_{26,1}\ H_{26,2}\ H_{26,3} \cdots$ | $H_{26,80}$ |
| — | — |
| — | — |
| — | — |
| $H_{48,1}\ H_{48,2}\ H_{48,3} \cdots$ | $H_{48,80}$ |

The detail of paging will be easily understood from the above description relating to scrolling.

Figure 9:
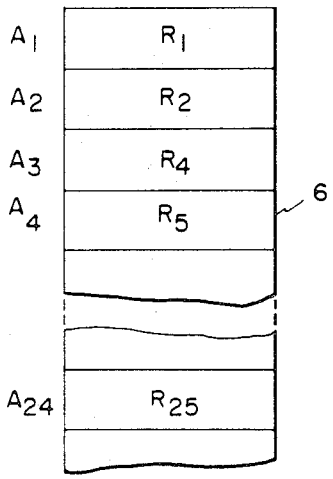
FIG. 9 is a diagrammatic representation of an example of the contents stored in the row address table when the CRT display apparatus shown in FIG. 1 is in the deleting operation.
Figure 10:
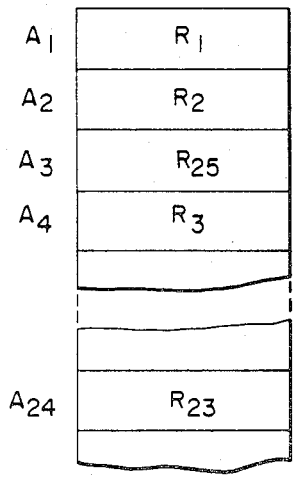
FIG. 10 is a diagrammatic representation of an example of the contents stored in the row address table when the CRT display apparatus shown in FIG. 1 is in the inserting operation.
Figure 11:
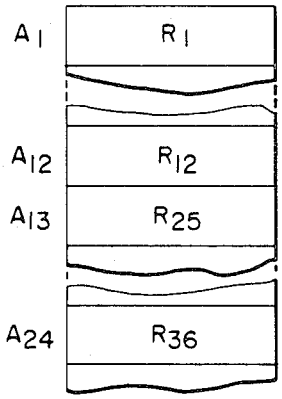
FIG. 11 is a diagrammatic representation of an example of the content stored in the row address table when the CRT display apparatus shown in FIG. 1 is in the partitioning operation.

According to the present invention, besides scrolling and paging, "deleting" (the operation for deleting one or more rows of character information displayed, and shifting character information under the character information deleted by the number of rows deleted upward), "inserting" (e.g., the operation for inserting different character information between the rows on the CRT screen), and partitioning (the operation for partitioning the screen into several parts and displaying different kinds of information on each part) can be easily carried out without rewriting the content of the regenerating buffer memory. For instance, if deletion of the character information stored in the row address $R_3$ of the regenerating buffer memory 4 is required, the row address $R_3$ is excluded in the row address table 6, and row addresses $R_1$, $R_2$, $R_4$, $R_5$, —are sequentially stored as shown in FIG. 9. If it is required that the character information stored in the row address $R_{25}$ be displayed between the character information stored in the row address $R_2$ of the regenerating buffer memory and the character information stored in the row address $R_3$, the row addresses are stored in the order of $R_1$, $R_2$, $R_{25}$, $R_3$, —as shown in FIG. 10. If it is required to display the character information stored in row addresses $R_1$ to $R_{12}$ on rows $\overline{Y}_1$ to $\overline{Y}_{12}$, on the CRT screen and the character information stored in row addresses $R_{25}$ to $R_{36}$ on rows $\overline{Y}_{13}$ to $\overline{Y}_{24}$, row address $R_1$ to $R_{12}$ and $R_{25}$ to $R_{36}$ are sequentially stored in the table 6 in such a manner that, for example, row addresses $R_1$ to $R_{12}$ are stored in addresses $A_1$ to $A_{12}$ of the row address table 6 and row addresses $R_{26}$ to $R_{36}$ are stored in addresses $A_{13}$ to $A_{24}$ of the row address table 6 as shown in FIG. 11.

Figure 12:
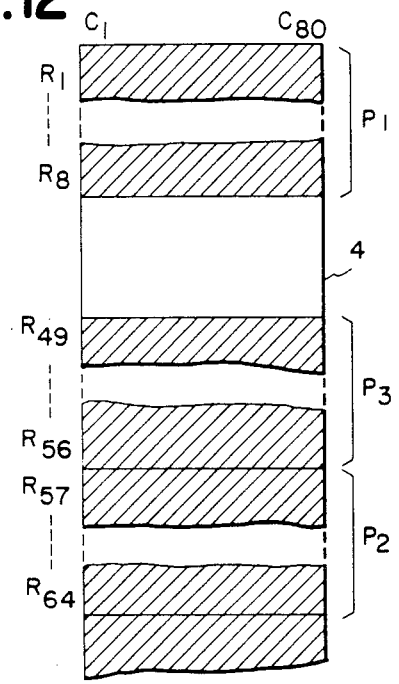
FIG. 12 is a diagrammatic representation of another example of the storage condition of the regenerating buffer memory.
Figure 13:
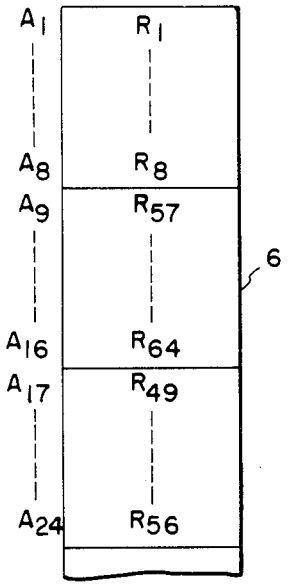
FIG. 13 is a diagrammatic representation of an example of the storage condition of the row address table when the regenerating buffer memory is under the storage condition shown in FIG. 12.

In the embodiment described above, the character information is stored in sequential addresses of the regenerating buffer memory. However, it should be noted that the present invention is not limited in such a method; the character information may be stored in any address of the regenerating buffer memory 4. For instance, even if the first character information $P_1$, second character information $P_2$ and the third character information $P_3$ are stored in row addresses $R_1$to $R_8$, $R_{57}$ to $R_{64}$, and $R_{49}$ to $R_{56}$, respectively as shown in FIG. 12, these are allowed to be displayed in the order of $P_1$, $P_2$ and $P_3$, provided that row addresses $R_1$ to $R_8$, $R_{57}$ to $R_{64}$, and $R_{49}$ to $R_{56}$ are stored in addresses $A_1$ to $A_8$, $A_9$ to $A_{16}$, and $A_{17}$ to $A_{24}$, respectively as shown in FIG. 13. In summary, since the order of display is determined by the arrangement of row addresses in the table 6, the character information may be stored in any address of the regenerating buffer memory 4.

The quantity of character information stored in the regenerating buffer memory 4 is not limited to the quantity for 3 frames, and any quantity may be stored. The storage capacity of the row address table 6 is not limited to the capacity for 3 frames. In summary, it is only required that the capacity of the table 6 is larger than for one frame.

Figure 14:
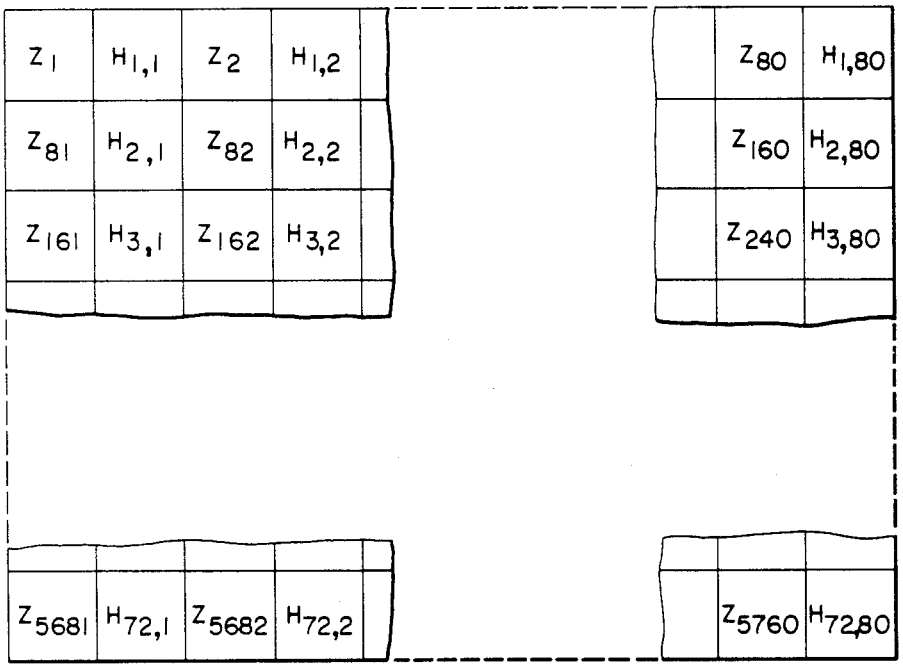
FIG. 14 is a diagrammatic representation of another organization of the regenerating buffer memory.

Furthermore, in the embodiment described above, the storage locations of the regenerating buffer memory are designated by row addresses $R_N$ and the outputs $C_M$ of the character counter. However, as shown in FIG. 14, the storage locations may be addressed by sequential numbers $Z_i$ (i=1, 2, 3, —, 5760). In this case the top (i.e., first) address of each row may be used instead of the row addresses described above.

Figure 15:
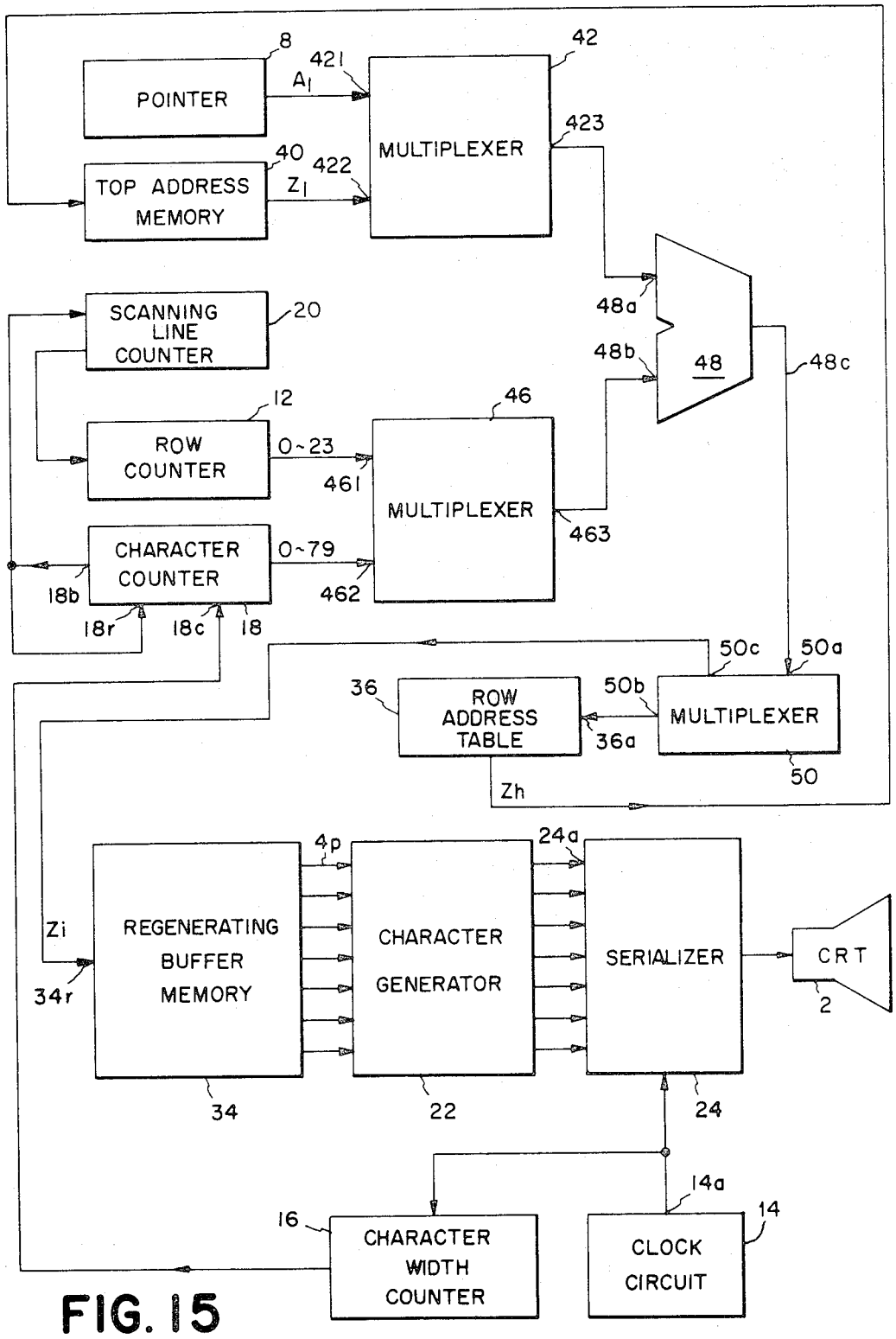
FIG. 15 is a schematic block diagram of another embodiment of the CRT display apparatus of the present invention.

FIG. 15 illustrates another embodiment of the present invention comprising a regenerating buffer memory organized as shown in FIG. 14. In FIG. 15, the row address table 36 selects, combines and arranges the top addresses Zh (h=1, 81, 161, —, 5681) of row wherein the character information to be displayed is stored among the character information stored in the regenerating buffer memory 34.

To simplify the description, it is assumed that the top addresses $Z_h$ are stored in the table addresses $A_N$(N=1, 2, —, 72) sequentially from small numbers. The top address memory 40 stores top addresses $Z_h$ read out from the row address table 36, and the output terminal of the top address memory 40 is connected to an input terminal 422 of a multiplexer 42. The other input terminal of the multiplexer 42 is connected to the output terminal of a pointer 8 organized similar to that of the first embodiment shown in FIG. 1. The output terminal 423 of the multiplexer 42 is connected to an input terminal 48*a* of an adder 48. The multiplexer 42 is controlled by the external controller (not shown) in such a manner that the output of the pointer 8 is fed to the input terminal 48*a* of the adder 48 in the top address readout mode for reading out top addresses $Z_h$ from the row address table 36 and that the output of the top address memory 40 is fed to the input terminal 48*a* of the adder 48 in the display mode for reading out characters from the regenerating buffer memory 34 and displaying those on the CRT 2.

The row counter 12 is organized similarly to that of the first embodiment of FIG. 1, and the output terminal of the row counter 12 is connected to an input terminal 461 of the multiplexer 46. Another input terminal 462 of multiplexer 46 is connected to the output terminal of the character counter 18 having the same organization and function as the character counter of the first embodiment. The output terminal 463 of the multiplexer 46 is connected to the other input terminal 48*b* of the adder 48. The multiplexer 46 is controlled by the external controller (not shown) in such a manner that the output of the row counter 12 is fed to the input terminal 48*b* of the adder 48 in the top address readout mode and that the output of the character counter 18 is fed to the input terminal 48*b* of the adder 48 in the display mode. The output terminal 48*c* of the adder 48 is connected to the input terminal 50*a* of the third multiplexer 50 whose output terminal 50*b* is connected to the address input terminal 36*a* of the row address table 36, and the other output terminal 50*c* of the multiplexer 50 is connected to the address input terminal 34*r* of the regenerating buffer memory 34. The multiplexer 50 is controlled by the external controller (not shown) in such a manner that the address input $A_n$ is fed to the row address table 36 in the top address readout mode and that the address inputs $Z_h$ is fed to the regenerating buffer memory 34 in the display mode. In this embodiment, the clock circuit 14, the character width counter 16, the scanning line counter 20, the character generator 22, and the serializer 24 are same as used in the first embodiment shown in FIG. 1.

The operation of the embodiment of FIG. 15 is hereinafter described starting from the display of character information corresponding to the top addresses stored in the first page memory 361 (see FIG. 16) of the row address table 36 (the memory corresponding to table addresses $A_1$ to $A_{24}$). In the top address readout mode, the pointer 8 outputs the address $A_1$ and the row counter 12 outputs "0". The output $A_1$ of the pointer 8 is fed to the input terminal 48*a* of the adder 48 through the multiplexer 42, the output "0" of the row counter 12 is supplied to the input terminal 48*b* of the adder 48 through the multiplexer 46, both inputs are added by the adder 48, and the adder 48 inputs the address $A_1$ to the address input terminal 36*a* of the row address table 36 through the multiplexer 50. Thus, the top address $Z_1$ is stored in the top address memory 40. Then, the operation is switched over from the top address readout mode to the display mode.

In the display mode, the multiplexer 42 feeds the output $Z_1$ of the top address memory 40 to the input terminal 48*a* of the adder 48 instead of the output $A_1$ of the pointer 8. On the other hand, the multiplexer 46 feeds the output "0" of the character counter 18 to the input terminal 48*b* of the adder 48 instead of the output "0" of the row counter 12. Thus, the adder 48 inputs the address $Z_1$ to the regenerating buffer memory 34 through the multiplexer 50. The character "$H_{1,1}$" stored in the address $Z_1$ of the memory 34 is fed to the character generator 22. The character generator 22 generates dots corresponding to the first scanning line (i.e. the scanning line corresponding to the coordinate $Y_1$ of the dot matrix of the row $\overline{Y}_1$ on the screen). These dots are serialized by means of the serializer 24 and inputted to the beam intensity controller of the CRT 2.

When the first scan of the character "$H_{1,1}$" is completed, the output of the character width counter 16 makes the output of the character counter 18 to be increased by one so that the output of the counter 18 is "1". The output "1" of the counter 18 is fed to the input terminal 48*b* of the adder 48 through the multiplexer 46. Since the top address $Z_1$ has been inputted to the input terminal 48*a* of the adder 48 through the multiplexer 42, the adder 48 outputs the address $Z_2$ which is in turn fed to the address input terminal 34*r* of the regenerating buffer memory 34 so that the character "$H_{1,2}$" stored in the address $Z_2$ of the regenerating buffer memory 34 is inputted to the character generator 22. The character generator 22 generates dots corresponding to the first scanning line of the character "$H_{1,2}$", and these dots are serialized by means of the serializer 24 and fed to the beam intensity controller of the CRT 2. Similarly, as the character counter 18 output numbers "2", "3", —, "79" sequentially, characters "$H_{1,3}$", "$H_{1,4}$", —, "$H_{1,80}$" stored in addresses $Z_3$, $Z_4$, —$Z_{80}$ are sequentially read out from the regenerating buffer memory 34, respectively. Thus the scan corresponding to the coordinate $Y_1$ of the dot matrix of the row $\overline{Y}_1$ on the CRT screen is completed.

When the first horizontal scan of the dot matrix is completed, the character counter 18 is reset and outputs "0" again. Then the address $Z_1$ is inputted to the regenerating buffer memory 34 from the adder 48 through the multiplexer 50 as described above, and the character "$H_{1,1}$" is read out from the regenerating buffer memory 34 and inputted to the character generator 22. The character generator 22 generates dots corresponding to the second scanning line of the character "$H_{1,1}$" (i.e. the scanning line corresponding to the coordinate $Y_2$ of the dot matrix of the row $\overline{Y}_1$ on the CRT screen). These dots are serialized by means of the serializer 24 and input to the beam intensity controller of the CRT 2.

When the second scan of the character "$H_{1,1}$" is completed, the output of the character width counter 16 makes the output of the character counter 18 to be increased by one, and makes the output of the counter 18 to be "1". The output "1" of the counter 18 and the output $Z_1$ of the top address memory 40 are inputted to the adder 48 through multiplexers 46 and 42, respectively, and the adder 48 outputs the address $Z_2$. Thus, the regnerating buffer memory 34 outputs the character "$H_{1,2}$", and the second scan of the character "$H_{1,2}$" is carried out in the same manner described above. Similarly, the second scan of characters "$H_{1,3}$", "$H_{1,4}$", —, "$H_{1,80}$" is carried out, and further the third to 16th scans (i.e. scans corresponding to coordinates $Y_3$ to $Y_{16}$ of the dot matrix) are repeated, and the CRT screen displays on the row $\overline{Y}_1$:

$$H_{1,1}\ H_{1,2}\ H_{1,3} — H_{1,80}$$

When the scan of the row $\overline{Y}_1$ on the CRT screen is completed, the scanning line counter 20 inputs a pulse to the counter 12, so that the row counter outputs "1". Then, the operation is switched over to the top address readout mode. The multiplexer 42 feeds the output "$A_1$" of the pointer 8 and the output "1" of the row counter 12 to the input terminal 48*b* and 48*b* of the adder 48 respectively. Then, the adder 48 feeds the table address "$A_2$" to the row address table 36 through the multiplexer 50, and the top address "$Z_{81}$" stored in the address "$A_2$" of the row address table 36 is read out. This top address "$Z_{81}$" is stored in the memory 40. Then the operation is switched over to the display mode, and the character information stored in the row corresponding to the top address $Z_{81}$ is displayed on the row $\overline{Y}_2$ of the CRT screen in the same manner that the character information of the row corresponding to the top address $Z_1$ described above is displayed on the line $\overline{Y}_1$ on the CRT screen. Thus, the CRT screen displays on rows $\overline{Y}_1$ and $\overline{Y}_2$, respectively, as follows:

$$H_{1,1}\ H_{1,2}\ H_{1,3} — H_{1,80}$$

$$H_{2,1}\ H_{2,2}\ H_{2,3} — H_{2,80}$$

Similarly, character information of rows corresponding to top addresses $Z_{161}$ to $Z_{1841}$ stored in addresses $A_3$ to $A_{24}$ of the row address table 36 is displayed. Since it will be easily understood by those skilled in the art that scrolling and paging may be carried out by changing addresses designated by the pointer 8, the detailed description is omitted.

In the above two embodiments, it was assumed that the table addresses designated by the pointer 8 is the table addresses to be first accessed. However, this is not the limitation of the present invention. For instance, the pointer may designate table address to be finally accessed. In this case, only a little change of the structure of the row counter is required.

In summary, it is sufficient that addresses indicating rows can be read out sequentially from a plural number of table addresses determined by table addresses designated by the pointer.

In the above two embodiments, the present invention is applied to the CRT screen having 24 rows of 80 characters. However, by making maximum counts of the row counter and/or character counter changeable, the present invention can be applied to any capacity of the CRT screen.

Furthermore, in the embodiment shown in FIG. 15, the top address memory 40, the multiplexers 42, 46 and 50, and the adder 48 are used for addressing the regenerating buffer memory organized as shown in FIG. 14. However, instead of this, the counter which can preset the top address $Z_h$ read out from the row address table 36 as the initial value may be provided for addressing the regenerating buffer memory by means of the output of such counter.

Furthermore, in the case of the memory structure as shown in FIG. 14, as shown in FIG. 17, the read-only memory 70 of the matrix type which generates address $Z_i$ of the regenerating buffer memory 34 by receiving the output $R_N$ (i.e. sequential number designating a row) of the row address table 6, and the outputs $C_M$ (i.e. sequential number designating character position) of the character counter 18 as shown in FIG. 1 may be used for addressing.

As seen from the above description, since the CRT display apparatus of the present invention comprises a regenerating buffer memory having a larger capacity to store character information than the display capacity of the CRT screen, stores addresses indicating rows of the memory for more than one frame in the required order, reads out row addresses stored in the table address for one frame sequentially from the table address designated by the pointer, and reads out and displays the character information stored in these row addresses, scrolling and paging can be carried out easily and quickly without rewriting the contents of the regenerating buffer memory and the row address table. Since the order of display of character information is determined by the arrangement of row addresses in the table, the required character information can be stored in the optional location in the regenerating buffer memory, which increases the flexibility of using the memory and is convenient particularly when the memory is shared with other units. The CRT display apparatus of the present invention also has an advantage that the information displayed can be edited by only rewriting the row addresses in the table without rewriting the contents of the regenerating buffer memory, and has a further advantage that adaptation to changing the display capacity of the screen can be easily obtained.

While the invention has been particularly shown and described with reference to preferred embodiments thereof, it will be understood by those skilled in the art that various changes in form and detail may be made therein without departing from the spirit and scope of the invention.

Having thus described my invention, what I claim as new, and desire to secure by Letters Patent is:

1. A cathode ray tube display apparatus comprising:

a cathode ray tube, a regenerating buffer memory for storing character information, having a storage capacity greater than the display capacity of the screen of said cathode ray tube;

a row address table having a capacity to store a larger number of addresses indicating the rows of said regenerating buffer memory than the number of rows in said screen, and storing said addresses indicating rows in desired order;

a pointer for designating an address of said row address table to determine the storing position to be accessed;

a row address read-out means responsive to a table address which is output from said pointer for reading the address indicating the row stored in said row address table;

a memory read-out means for reading out from the regenerating buffer memory character information stored in the row indicated by the address which has been read out from said row address table; and a display means for displaying visually the character information which has been read out from said regenerating buffer memory.

2. A cathode ray tube display apparatus as claimed in claim 1, wherein said regenerating buffer memory is a random access memory.

3. A cathode ray tube display apparatus as claimed in claim 1, further comprising a control means for setting the desired table address in said pointer.

4. A cathode ray tube display apparatus as claimed in any of claim 1 to claim 3, wherein said row address read-out means has a counter and an adder which adds the output of said counter to the output of said pointer, and the output of said adder indicates the address of said row address table.

5. A cathode ray tube display apparatus as claimed in claim 4, wherein the table address designated by said pointer is the table address to be accessed first, and the count of said counter increases sequentially from 0 to the number corresponding to the number of rows on said screen.

6. A cathode ray tube display apparatus as claimed in any of claims 1 to claim 3, wherein said address indicating row is the top address designating the first character stored in each row of said reproducing buffer memory.

7. A cathode ray tube display apparatus as claimed in claim 6, wherein said memory read-out means comprises a top address memory storing the top address which has been read out from said row address table, a character counter designating the location of characters stored in each row of said regenerating buffer memory, and an adder for adding the output of said top address memory to the output of said character counter, and the output of said adder indicates the address of said reproducing buffer memory.

8. A cathode ray tube display apparatus as claimed in claim 6, wherein said memory read-out means comprises a counter which increases the count sequentially starting from the top address read out from said row address table as the initial value, and the output of said counter indicates the address currently accessed within said regenerating buffer memory.

9. A cathode ray tube display apparatus as claimed in claim 1 to claim 3, wherein said memory read-out means comprises a character counter designating the location of characters stored in each row of said reproducing buffer memory, and a read-only memory which outputs the address currently accessed within the regenerating buffer memory addressed by the address indicating row output from said row address table and the output of said character counter.

10. A cathode ray tube display apparatus as claimed in claim 4, wherein said address indicating row is the top address designating the first character stored in each row of said reproducing buffer memory.

11. A cathode ray tube display apparatus as claimed in claim 10, wherein said memory read-out means comprises a top address memory storing the top address which has been read out from said row address table, a character counter designating the location of characters stored in each row of said regenerating buffer memory, and an adder for adding the output of said top address memory to the output of said character counter, and the output of said adder indicates the address currently accessed within said reproducing buffer memory.

12. A cathode ray tube display apparatus as claimed in claim 10, wherein said memory read-out means comprises a counter which increases the count sequentially starting from the top address read out from said row address table as the initial value, and the output of said counter indicates the address currently accessed within said regenerating buffer memory.

13. A cathode ray tube display apparatus as claimed in claim 5, wherein said address indicating row is the top address designating the first character stored in each row of said reproducing buffer memory.

14. A cathode ray tube display apparatus as claimed in claim 13, wherein said memory read-out means comprises a top address memory storing the top address which has been read out from said row address table, a character counter designating the location of characters stored in each row of said regenerating buffer memory, and an adder for adding the output of said top address memory to the output of said character counter, and the output of said adder indicates the address currently accessed within said reproducing buffer memory.

15. A cathode ray tube display apparatus as claimed in claim 13, wherein said memory read-out means comprises a counter which increases the count sequentially starting from the top address read out from said row address table as the initial value, and the output of said counter indicates the address currently accessed within said regenerating buffer memory.

* * * * *